United States Patent [19]

Ryan

[11] Patent Number: 4,936,506

[45] Date of Patent: Jun. 26, 1990

[54] SWIMMING POOL FOUNTAIN

[76] Inventor: James E. Ryan, 6211 Indian Mound Dr., McFarland, Wis. 53558

[21] Appl. No.: 270,232

[22] Filed: Nov. 14, 1988

[51] Int. Cl.[5] ..... B05B 17/08

[52] U.S. Cl. ..... 239/18; 239/23

[58] Field of Search ..... 239/12, 17, 18, 19, 239/20, 22, 23

[56] References Cited

U.S. PATENT DOCUMENTS

| | | | |
|---|---|---|---|
| 3,030,028 | 4/1962 | Hruby, Jr. | 239/17 |
| 3,318,528 | 5/1967 | Williams | 239/17 |
| 3,577,571 | 5/1971 | Bellinson et al. | 4/172.17 |
| 3,722,816 | 3/1973 | Stewart et al. | 239/17 |
| 3,831,852 | 8/1974 | Stillman | 239/201 |
| 3,838,816 | 10/1974 | Huff et al. | 239/18 |
| 4,088,880 | 5/1978 | Walsh | 239/18 |
| 4,174,808 | 11/1979 | Latin | 239/23 |
| 4,416,420 | 11/1983 | Thompson | 239/22 |
| 4,749,126 | 6/1988 | Kessener et al. | 239/18 |

FOREIGN PATENT DOCUMENTS

| | | | |
|---|---|---|---|
| 2562637 | 10/1985 | France | 239/18 |
| 2105615 | 3/1983 | United Kingdom | 239/279 |

OTHER PUBLICATIONS

Photocopy of a brochure describing a Wonderfall Swimming Pool Fountain, Dunn-Rite Products, Elwood, Ind., copyright 1988.

Photocopy of the back of the packaging of a Wonderfall Swimming Pool Fountain.

Photocopy of an informational letter concerning the Wonderfall Swimming Pool Fountain.

*Primary Examiner*—Andres Kashnikow

*Assistant Examiner*—Karen B. Merritt

*Attorney, Agent, or Firm*—Foley & Lardner

[57] ABSTRACT

A swimming pool fountain which can be installed in any existing pool, hot tub, spa or the like and is capable of adjustment to any water level height, variation in spray pattern, pinch and direction, and illumination of the fountain spray.

4 Claims, 2 Drawing Sheets

SWIMMING POOL FOUNTAIN

TECHNICAL FIELD

This invention relates generally to fountains, and, in particular, to a fountain suitable for installation in a swimming pool, a hot tub, a jacuzzi or the like.

BACKGROUND OF THE INVENTION

Owners of swimming pools, spas or similar recreational water appliances often desire to install fountains in them to provide a decorative effect or to provide relaxing background sound, especially when the, e.g., pool is not being used, such as during the evening. Typically, a fountain must be served by a pressurized water supply. The water is delivered to a nozzle or fountain head having one or more discharge orifices. The pressurized water is discharged at or above the surface of the water in the pool through the nozzle or fountain head in a spray.

In a swimming pool, the water supply is usually delivered by the recirculating and filtering system. However, most fountains have been found to be unsuitable for use in swimming pools. Generally, the prior art devices require special installation into the pool structure, clutter the pool with structures both below and above the water land, are not readily removable, and, if allowed to remain in the pool during active use, may constitute safety hazards for people using the pool or spa.

A particularly vexatious problem is the requirement of special installation. Many prior art swimming pool fountains require installation during construction of the pool itself or require modification of some structural aspect of the existing pool. For example, one such fountain requires installation in the floor of a swimming pool. See, for example, Stewart, et al., U.S. Pat. No. 3,722,816, issued Mar. 27, 1973. Another fountain system provides a plurality of discharge nozzles around the periphery of the pool and requires installation of quick disconnect coupling sockets within the pool wall. See, for example, Bellinson, et al., U.S. Pat. No. 3,577,571, issued May 4, 1971. Yet another fountain system requires encasement of nozzles in the leading edge of the coping around the swimming pool. See, for example, Stillman, U.S. Pat. No. 3,831,852, issued Aug. 27, 1974.

Yet another problem in many pool fountains is lack of regulation of the water flow to the discharge head of the fountain. Most swimming pool fountains simply have an on-off valve installed at some point in the water recirculating system. See, for example, Stewart, et al., '816, and Bellinson, et al., '571.

Other deficiencies in most fountains include the lack of variability of the spray pattern and the pitch of the spray. Most fountains have fixed spray patterns as the water is usually discharged from a nozzle or a fixed head. See, for example, Bellinson, et al., '571. A prior art fountain has been described where the spray pattern may be varied by changing the fountain head. See, for example, Stewart, et al., '816. Most fountains have fixed spray pitch, i.e., the angle of the spray as it emerges from the fountain head relative to the surface of the water in the pool. Most nozzles or fountain heads are fixed in a vertical position. See, for example, Bellinson, et al., '571, and Stewart, et al., '816. Furthermore, the prior art referenced above does not provide for added aesthetics, to be provided by associating a lighting system with the fountain devices.

Despite recognition of these problems, none of the prior art apparatus provides features of installation in existing pool equipment, use in either above-ground or in-ground pools or smaller units such as spas or hot tubs, variable spray patterns, or the additional aesthetic enhancement of lighting of the water spray. The present invention provides a swimming pool fountain capable of connection with any existing water source, variable spray patterns, convenient adjustment to any water level height, and illumination of the fountain spray.

SUMMARY OF THE INVENTION

The present invention provides a swimming pool fountain which can produce a spray above the surface of the water in a pool and is suitably installed in any existing pool, above or below ground, a hot tub, spa or the like. The fountain in accordance with one aspect of the present invention is capable of connection with any existing pressurized water supply, adjustment to any water level height, variation in spray direction and pitch, and illumination of the spray.

The swimming pool fountain in accordance with a preferred embodiment of this invention includes a fountain head having at least one spray orifice for discharging water flow under pressure in a spray pattern over the swimming pool and a conduit for conveying water for the fountain head. The conduit is configured to present the fountain head proximate the surface of the water in the pool to establish the spray above the surface of the water and includes a coupling member for connecting it to a return water inlet disposed beneath the surface of the water. The fountain also includes a valve operatively associated with the conduit for regulating water flow to the fountain head.

The fountain of this preferred embodiment may also include a swivel member in operative association with the fountain head for adjusting the angle of the fountain head relative to the surface of the water, an adjusting member for positioning in the fountain head as desired relative to the height of the water in the pool, and a spray member for directing and patterning the water spray.

According to another aspect of the present invention, the fountain may include a lighting system in operative association with the fountain head for illuminating the water spray issuing from the head.

In another embodiment of the fountain, the conduit may be a flexible hose and the fountain head then comprises a body configured to hold a predetermined amount of water to achieve a stationary position for the head in response to the forward force of the discharged water spray. This body may be positioned on the deck of the pool or may be buoyant and positioned in the water at or near the surface.

BRIEF DESCRIPTION OF THE DRAWING

The preferred exemplary embodiment of the present invention will hereinafter be described in conjunction with the appended drawing, wherein like designations denote like elements, and.

DETAILED DESCRIPTION

The present invention relates to fountains suitable for use in swimming pools. The fountain of the present invention is characterized by several attributes: simple installation into the existing pressurized water supply of a swimming pool, built-in regulation of water flow, and variation in spray pattern and spray pitch, and lighting of the spray, as well as convenient storage. These attributes are achieved through a special combination of structural components.

As used herein, the term "swimming pool" is meant to describe above- and below-ground pools, hot tubs, spas, and any other body or tank of water used for exercise, relaxation or pleasure. A "return water inlet pipe" is typically a discharge pipe or line which returns water to the swimming pool after the water has passed through a recirculating/filtering system, although any water supply may conveniently be adapted to provide a feed for the instant fountain. Regardless, the system supplies a source of pressurized water to the fountain. Such water inlets are generally found in the pool wall below the water surface, typically about 15 to 20 cm (6 to 8 inches) below the surface, although the distance may vary from pool to pool.

An important feature of the fountain of the present invention is the ability to vary the pitch and direction of the spray by means of a swivel member. This allows the fountain head to be positioned across a spectrum of angles relative to the surface of the water in addition to a vertical position.

A further feature of the present invention is a lighting system for illuminating the spray as it is is discharged from the fountain head. The lighting system is in operative association with the fountain head. In a preferred embodiment, the lighting system is disposed in an orifice in the fountain head with the light beam directed through a transparent fountain head face, using fiber optic principles of illumination.

Adjustability to water height of the pool is another important characteristic of the present invention. The distance that the return water inlet is located below the water surface may vary according to individual pool design. The fountain, in accordance with the present invention, is capable of adjustment so that the fountain is proximate the water's surface.

Additional advantages of the fountain of the present invention are simplicity and economy of construction, ease of operation, and convenient storage.

Figure 1:
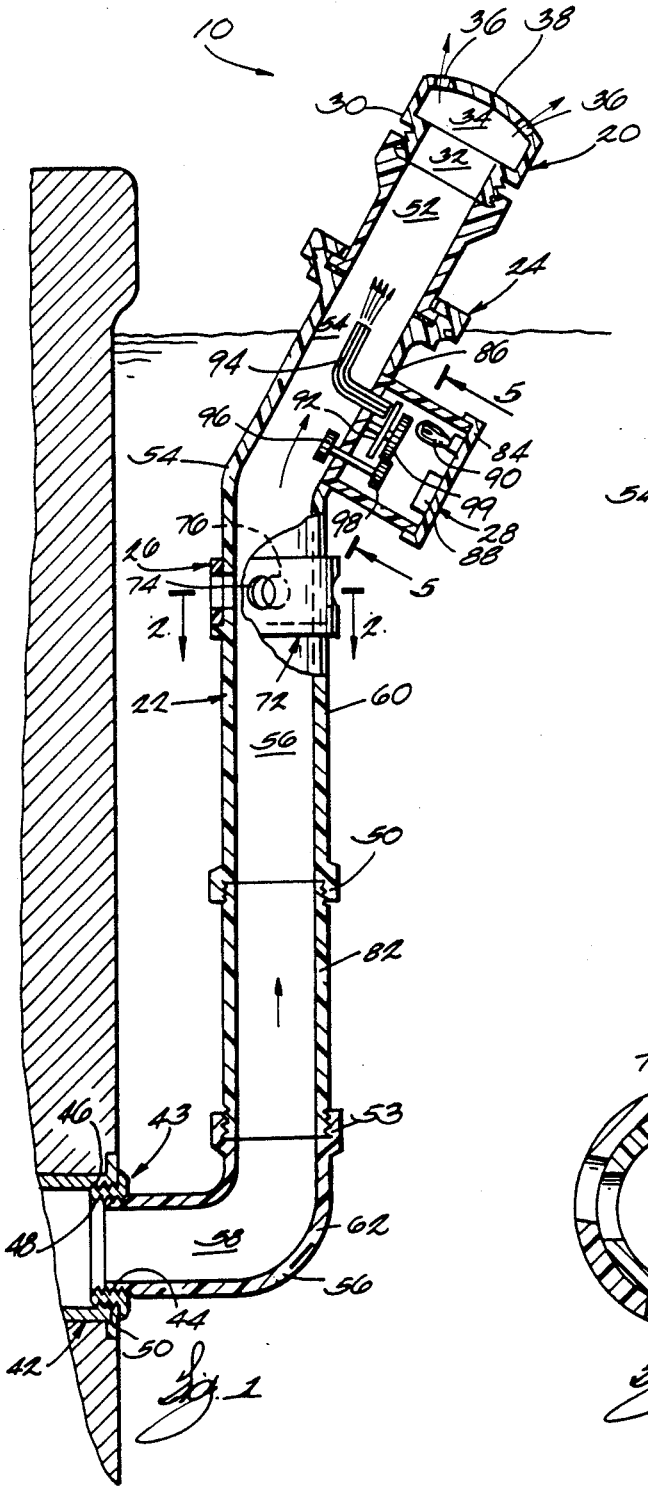
FIG. 1 is a sectional view of the fountain with a portion being a side view to show one type of valve, all in accordance with the present invention.
Figure 5:
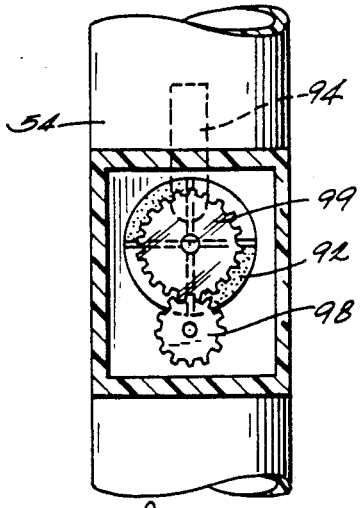
FIG. 5 is a view of the fountain taken along lines 5—5 of FIG. 1.

Referring now to FIG. 1, in accordance with one aspect of the invention, fountain 10 includes a fountain head designated generally as 20, a conduit designated generally as 22, a swivel member designated generally as 24, a valve designated generally as 26 and a lighting system designated generally as 28. Fountain head 20 comprises a hollow body 30 having a generally cylindrical form and includes an inlet 32 through which pressurized water is received from the conduit 22 and an outlet 34 through which water is discharged, in this instance shown as an array of discharge orifices 36.

As shown in FIG. 1, the inside diameter of body 30 may be somewhat larger than that of conduit 22 to accommodate a larger outlet 34 for a more distinct spray pattern. In this case, the inlet portion 32 of fountain head 20 is suitably downsized to the diameter of conduit 22 by having generally inwardly sloping walls which meet and connect with the walls of conduit 22. Alternatively, the inside diameter of body 30 may be dimensioned to be the same as that of the conduit 22.

Figure 3:
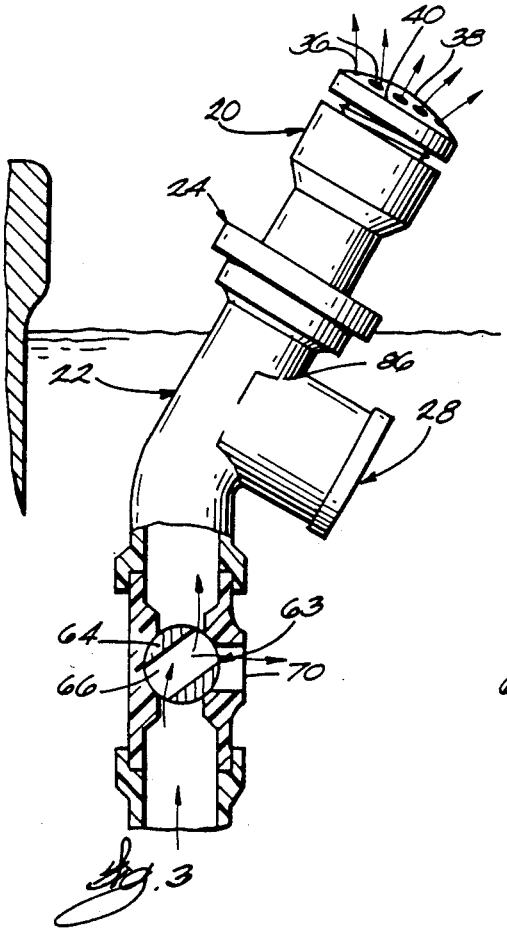
FIG. 3 is a side view of the fountain with a portion broken away to show another type of valve.

Outlet 34 comprises a spray means, as illustrated in the preferred embodiment, to disperse the water in a spray pattern as shown in FIG. 3. The spray means may simply include one or more orifices 36 in the fountain head or a nozzle. Preferably, the spray means comprises a fountain head face 38 having at least one orifice 36. Face 38 may be conveniently a circular solid with opposing surfaces, shown as a simple convex wall in FIG. 1. Most preferably, face 38 has a plurality of orifices 36, each having a tube 40 disposed therein and protruding about 0.65 cm (0.25 in) above the face 38 of the fountain head, as shown in FIG. 3. Each orifice is dimensioned such that its diameter corresponds to the outside diameter of tube 40, typically about 0.65 cm (0.25 in). These tubes are positioned at diverging angles from each other to facilitate a distinct spray path for the water discharged through each tube. Alternatively, the contour of face 38 may be flat, but the preferred convex shape facilitates the divergence of the direction of the tubes to provide a more distinct spray pattern.

In a most preferred embodiment, fountain head faces 38 are interchangeable. Fountain head faces with different positioning of the orifices and tubes therein may be employed to provide a variety of spray patterns. Additionally, fountain head face 38 may also be rotatable, for example, through a 90° angle, to allow for a variation in the spraying pattern.

The fountain head and face are suitably constructed of a rigid plastic, for example, polyvinylchloride or high density polyethylene. Fountain head face 38 may also be constructed of a transparent material, for reasons to be explained below.

Conduit 22 is shown in the form of tubing connected to a return water inlet pipe 42 for delivering water to the fountain head 20. Conduit 22 includes a coupling member designated generally as 43 for connecting it to a return water inlet pipe 62. Coupling member 43 may be provided in the form of threads 46 on a bottom end 44 of conduit 22, complementary to threads 48 of an outlet end 50 of water inlet pipe 42. Alternatively, if end 50 of water return pipe 42 lacks threads, it may be convenient to sweat a fitting into end 50 so that end 44 of conduit 22 may snaplock into pipe 42 in a conventional manner. It may also be necessary to accommodate the diameter size of the water inlet pipe 42 to that of the conduit 22. A variety of plumbing adapters is available, for example, a downsizer.

Skilled artisans will recognize that conduit 22 may be shaped in a variety of configurations, but is so configured to present the fountain head proximate the water surface so that a spray above the surface is established. Such variations, including a fountain head and conduit comprising a single unit, are contemplated to be within the scope of the present invention.

In one embodiment, conduit 22 may be generally S-shaped with an upper end 52 which is joined to end 32 of fountain head 20, a generally upwardly inclined portion 54, a generally vertical portion 56, a generally downwardly inclined portion 58 and bottom end 44. If conduit 22 and fountain head 20 are separate pieces, they may be joined by any convenient means such as complementary threading or snaplocking.

In another embodiment, although still S-shaped, conduit 22 may simply comprise two tubes, a first tube 60 and an elbow tube 62. Tube 60 has a first end connected to fountain head 20 and the second end connectable in some suitable fashion, such as threads or snap-locks, to a first end of elbow tube 62. The second end of elbow tube is suitably connectable to the water inlet pipe 42, as was explained above.

Figure 4:
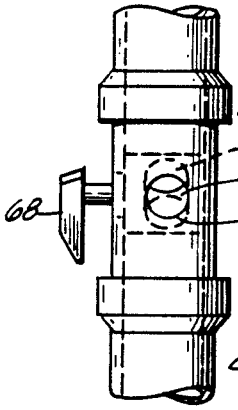
FIG. 4 is a fragmentary side view of the valve shown in FIG. 3.
Figure 6:
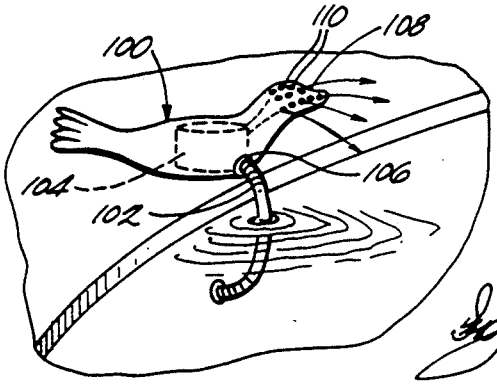
FIG. 6 is a perspective view of another embodiment of the present invention.

Fountain 10 includes a valve 26 for regulating the flow of water to head 20. A variety of valves and positions thereof may be suggested to the skilled artisan. For example, such a valve may comprise a ball valve 63 as shown in FIGS. 3 and 4, positioned within conduit 22. Ball 64 has a centrally disposed channel 66 therethrough. Ball 64 is operational via an external lever 68 connected to the ball. Movement of lever 68 alters the position of the ball 64 so that water will either be expelled through the fountain head or may be returned to the swimming pool or both.

In the open position, ball 64 covers an opening 70 in conduit 22 and channel 66 is aligned with the inside diameter of conduit 22. Water flow is thus directed to fountain head 20. In the closed position, ball 64 is positioned so that it completely blocks C conduit 22, and channel 66 is generally aligned with opening 70, thus blocking water flow to fountain head 20. Water is returned to the pool via opening 70. Intermediate positioning of lever 68 will vary water flow from fully open to fully closed. Thus, the amount of water to the fountain head may be conveniently regulated.

Figure 2:
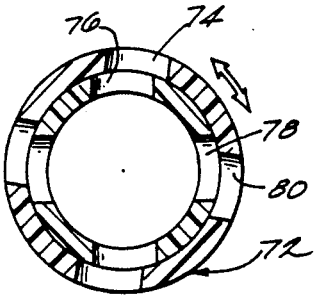
FIG. 2 is a sectional view of the fountain taken along lines 2—2 of FIG. 1.

As shown in FIGS. 1 and 2, the valve 26 may also include a port hole valve 72 with inner cylindrical portion 78 with holes 76 and outer cylinder 80 with holes 74. Outer cylinder 80 is rotatable about inner cylindrical portion 78. When port holes 74 of outer cylinder 80 are aligned with port holes 76 of inner cylindrical portion 78, water flow returns to the pool through the aligned port holes. When outer cylinder 80 is rotated so that port holes 74 are completely covered by a solid wall portion of inner cylindrical portion 78, water flows to the fountain head. Intermediate positions are also possible to vary the pressure of water flow to the head. Valve 26 may be suitably disposed proximate fountain head 20.

In yet another aspect of the present invention, the swivel member 24 is provided to adjust the pitch of the fountain head 20 and, hence, the pitch and direction of the spray. Those skilled in the art will recognize that a swivel joint may be disposed at a variety of positions. For example, swivel joint 24 may be disposed intermediate the fountain head and the conduit. In this case, swivel joint 24 suitably has a first end connectable to the fountain head 20 and the second end of swivel joint connectable to the conduit 22, as shown in FIG. 1.

As noted above, conduit 22 is connected to return water inlet 42. The distance that pipe 42 is below the surface of the water may differ from pool to pool. In a further aspect of the invention, means for adjusting the fountain head to the height of the water is provided. Many means, such as telescoping pipe with twist locking, may be suggested to those skilled in the art to achieve such adjustment. In one embodiment, as shown in FIG. 1, a simple extension tube 82 may be accommodated in spaced relation between tube 60 and elbow tube 62 of the conduit 22, connectable to both in suitable threaded or snaplock fashion.

The fountain head may further comprise a lighting system 28 in operative association with the fountain 10 for illuminating the water spray issuing from the fountain head 20. Lighting may be accomplished by a variety of means—for example, directly with a light beam or indirectly with a light beam plus mirrors.

Figure 7:
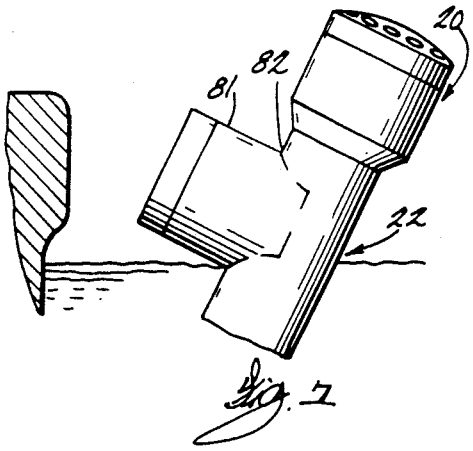
FIG. 7 is a side view of the top portion of the fountain in accordance with the present invention.

In one preferred embodiment, as shown in FIGS. 1 and 7, the lighting system is illustrated in the form of a sealed unit 84 mounted in an orifice 86 of conduit 22 wherein the light beam emanating from the unit is transmitted through face 38, which is constructed of a transparent material, such as polymethacrylate.

System 28 comprises a battery 88, a light bulb 90, colored filters 92, optic fibers 94, a gear 96 external to the unit 84 cooperatively associated with gears 98 and 99 inside unit 84.

The colored filters 92 are operatively associated with the internal gears 98 and 99. Filters 92 may be mounted in regular fashion about a wheel having spokes, hub, and axle shaft with end portion comprising the internal gear 96. The external gear 96 extends into the inside of the conduit 22 and is propelled by the water flow to the fountain head 20. When gear 96 rotates, internal gear 98 rotates. Gear 98 rotates gear 99 which, in turn, rotates colored filters 92. The cooperation of the gears allows rotation of filters 92 to proceed at a slower rate than gear 96 is rotated. One or more filters of optional colors, such as red, blue, green and yellow, may be used in the light unit.

The light unit 84 suitably may use rechargeable batteries. Light unit 84 may also be positioned such that a portion of unit 84 is exposed to sunlight, as shown in FIG. 7, whereby a solar cell (not shown), appropriately affixed to unit 84 and connected to battery 88, may recharge battery 88.

When the light is lighted, the beam is transmitted via optic fibers 94, which are directed toward face 38. The beam passes through face 38 and illuminates the spray as it is discharged from head 20.

Alternately, the light unit may be positioned external to the fountain, such as on the pool deck, with the emanating beam directed to the spray.

In another aspect of the invention, fountain head may comprise a body 100 and the conduit a flexible hose 102. Hose 102 may be suitably constructed of, for example, polyethylene. Body 100 includes a hollow internal cavity 104, an inlet 106 and an outlet 108 having one or more orifices 110. Body 100 includes a fixturing means for maintaining the body in a stationary position in response to the forward force of the discharged water. During operation of the fountain, fixturing means may be provided by filling body with a predetermined amount of water. The weight of the water filling body 100 is sufficient to maintain body 100 in a stationary position on the deck or other surface of the pool.

Body 100 may also be "buoyant." The term "buoyant" is used to describe a property of neutral buoyancy or slightly positive buoyancy as those terms are generally recognized in the art. When cavity 104 of body 100 is filled with water, the weight of the water is sufficient to maintain body 100 in a stationary position in the water yet allow body 100 to float on or near the surface of the water.

Body 100 may be in the shape of any object, but desirably some aquatic object, such as a mermaid, dolphin, swan, etc.

In the operation of the fountain in accordance with the present invention, water flow from the water inlet pipe enters the conduit and continues to the fountain head where it is discharged in a selected, desirable spray pattern, angled to be confined within the pool. The water flow to the head is regulated by one or more valves operatively associated with the conduit.

In the preferred embodiment, the spray may take on any of several patterns as the fountain head comprises interchangeable faces, each having orifices with tubes angled to direct a particular spray pattern. Also, as noted herein, the fountain head face may also be rotatable to change the spray pattern.

In addition to providing aesthetic and relaxing aspects, the swimming pool fountain in accordance with the present invention provides aeration and temperature control of the water. As water is being sprayed out, it will be cooled by the surrounding air if the air temperature is cooler than the water temperature. Conversely, if the water in the pool is cooler than the air temperature and there is sufficient sunlight, spraying will tend to heat the water returning to the pool from the fountain. Thus, the fountain can contribute to temperature control. The spray also aerates the water by mixing air with water as the water spray contacts and entrains air bubbles.

The fountain is also conveniently stored so that it does not constitute a safety hazard for people using the pool. The fountain may be stored by simply twisting the conduit at the inlet connection and placing the fountain in a generally horizontal position which is close to the pool walls and out of the way of users of the pool. Alternatively, the fountain may be readily removed from pool by disconnecting it at the return water pipe.

Modifications of the present invention may be suggested to or made by those of ordinary skill in the art without departing from the scope of the invention as expressed in the appended claims.

I claim:

1. A swimming pool fountain, comprising:

a fountain head having at least one spray orifice for discharging a water flow under pressure in a spray pattern over a swimming pool;

a conduit for conveying water to said fountain head, configured to present said fountain head proximate the surface of the water in the pool to establish the spray above the surface of the water, said conduit including coupling means for connecting the same to a return water inlet disposed beneath the surface of the water;

valve means operatively associated with said conduit for regulating water flow to said fountain head; and lighting means in operative association with said fountain head for illuminating the water spray issuing therefrom; said lighting means comprising a sealed unit disposed in an orifice in said fountain head, said unit comprising a light bulb connected to a battery, optic fibers for directing a light beam emanating from said light bulb, an external gear propelled by the water flow to said fountain head, an internal gear operative connected to said external gear, and colored filters operative connected to said internal gear.

2. A swimming pool fountain, comprising:

a fountain head having at least one spray orifice for discharging a water flow under pressure in a spray pattern over a swimming pool;

a conduit for conveying water to said fountain head, configured to present said fountain proximate the surface of the water in the pool to establish the spray above the surface of the water, said conduit including coupling means for connecting the same to a return water inlet disposed beneath the surface of the water; and a valve operatively associated with said conduit for regulating water flow to said fountain head, said valve comprising a port hole valve including an inner cylinder having port holes and an outer cylinder having port holes rotatable about said inner cylinder for positioning said port holes of said outer cylinder with said port holes of said inner cylinder.

3. The fountain of claim 2, wherein said valve is proximate said fountain head.

4. The fountain of claim 2, wherein said conduit is S-shaped.

* * * * *